US009516904B2

(12) United States Patent
Hearty

(10) Patent No.: US 9,516,904 B2
(45) Date of Patent: Dec. 13, 2016

(54) UPPER BODY GARMENT FOR PROVIDING SUPPORT

(71) Applicant: Carol A Hearty, Carmel, NY (US)

(72) Inventor: Carol A Hearty, Carmel, NY (US)

( * ) Notice: Subject to any disclaimer, the term of this patent is extended or adjusted under 35 U.S.C. 154(b) by 262 days.

(21) Appl. No.: 14/076,210

(22) Filed: Nov. 9, 2013

(65) Prior Publication Data

US 2014/0134922 A1 May 15, 2014

Related U.S. Application Data

(60) Provisional application No. 61/724,489, filed on Nov. 9, 2012.

(51) Int. Cl.
*A41C 3/08* (2006.01)
*A41F 15/00* (2006.01)

(52) U.S. Cl.
CPC *A41C 3/08* (2013.01); *A41F 15/00* (2013.01)

(58) Field of Classification Search
CPC ..... A41C 3/00; A41C 1/00; A41C 3/0014; A41C 3/0071; A41C 3/0078; A41C 3/06; A41C 3/065; A41C 3/08
USPC ..... 450/86, 88, 8, 9, 10, 26–28, 30–33, 1; 2/73–75, 102, 105, 80, 83
See application file for complete search history.

(56) References Cited

U.S. PATENT DOCUMENTS 1,699,923 A * 1/1929 Rothstein ..... A41F 15/00 450/86
3,094,125 A * 6/1963 Lewis ..... A41C 3/148 450/59
3,421,514 A * 1/1969 Friedlander ..... A41D 27/136 2/54
4,552,144 A * 11/1985 Selvaggi ..... A41C 3/00 450/86
8,241,088 B2 * 8/2012 Murphy ..... A41C 3/08 450/1
8,522,362 B1 * 9/2013 Stones ..... A41D 7/00 2/67
8,808,056 B2 * 8/2014 Murphy ..... A41C 3/08 450/1
2011/0223832 A1 * 9/2011 Rose ..... A41C 3/08 450/86
2012/0115397 A1 * 5/2012 Forbes ..... A41C 3/04 450/86
2013/0017760 A1 * 1/2013 Kadium ..... A41C 3/148 450/30

* cited by examiner

*Primary Examiner* — Gloria Hale
(74) *Attorney, Agent, or Firm* — White-Welker & Welker, LLC; Matthew T Welker, Esq.

(57) ABSTRACT

An upper body undergarment with two wide strap or garment style shoulders connected to a full-support bra at two front points. The straps are made from any suitable material, and is widest at the points of attachment to the bra, in this case the front of the subject embodiment where it is stitched directly to the cups, or made removable as per the description of the back ends of the straps. The straps then taper towards the apex of the shoulders to fit the width of a wearer's shoulders. The cups of the brassiere can be of any method or material generally employed in the art of support bra construction. The side panels of the brassiere connect from the outer sides of the cups around to the back of the wearer, and also serve to connect to the wide strap or garment style shoulders. Restickable or repositionable adhesive is used to create adjustment, fastening, or closure, or removable or other attachment in the undergarment.

17 Claims, 7 Drawing Sheets

UPPER BODY GARMENT FOR PROVIDING SUPPORT

CROSS REFERENCE TO RELATED APPLICATIONS

This application claims priority from U.S. patent application Ser. No. 61/724,489, entitled "An upper body garment for providing support", filed on 9 Nov. 2012. The benefit under 35 USC §119(e) of the United States provisional application is hereby claimed, and the aforementioned application is hereby incorporated herein by reference.

FEDERALLY SPONSORED RESEARCH

Not Applicable

SEQUENCE LISTING OR PROGRAM

Not Applicable

TECHNICAL FIELD OF THE INVENTION

The present invention relates generally to an upper body garment. More specifically, the present invention relates to an upper body support garment for supporting the breasts and upper body.

BACKGROUND OF THE INVENTION

Bra strap designs have been largely unchanged for decades. Women believe they must live with straps that dig into their shoulders to the point where it may result in numbness in their fingers as the straps each pressed on a nerve, straps that irritatingly drop off the shoulders, and straps that dig into the flesh around the upper torso, producing visible bra lines that show unaesthetically through outerwear.

Some bra designs have attempted to address one or more of these problems, but have never comprehensively and/or aesthetically addressed the various issues of the traditional paradigm. They may have produced a wider, but not significantly wider, strap, which would still dig into the shoulder and/or fall by pivoting off the shoulder, and which may have also presented a practical, industrial appearance or the brassiere may have been made as a less supportive stretch garment. Such garments do not teach the use of adjusting the strap length or angle. The stretchiness is the adjustment, but it offers only limited support, as it is so elastic and untailored in the cups, rather than firm with engineered, tailored, supportive, patterned or molded construction.

Traditional strap attachments commonly incorporate a ribbon-like strap with a slide buckle. At times the strap may be wider, but not very wide apparently due to the fact that they rely upon the traditional slide buckle strap adjustment method. Wider straps are either slightly wider versions of the traditional slide-buckle adjusting straps, or are of a soft elastic strap with less support.

Some strap contraptions have a very complicated, industrial unaesthetic embodiment, have a strap wider at the top to prevent straps digging into the shoulder. They also have an industrial appearance, and would pivot to drop off the shoulder. They show no method of length adjustment. If there is a very wide strap or garment style shoulder, it is not adjustable.

While some garments taught in the prior art address the problem of visible bra lines, but more in the manner of a tank garment rather than as an intrinsic part of the full-support bra design. Other tank tops that incorporate a bra, actually "shelf bra", are not full support, and usually have the uncomfortably flesh-digging narrow straps resulting in less support than most stand-alone brassieres.

No prior art addresses all of the issues of the brassiere in one attractive, comprehensive embodiment including addressing: straps that dig into the shoulders, straps that pivot and drop off the shoulders, and straps that cause visible bra lines due to the welling up of flesh around the straps and other parts of the bra, that can also adjust to the wearers' size.

Furthermore, brassieres and other garments have traditionally been size and shape adjusted and connected using snaps, hooks, zippers, buckles, and other mechanical means, and may be employed in the embodiments illustrated in this application. A restickable or repositionable adhesive is also desirable, as it presents a smooth, thin profile, and offers a particular quality of flexibility in adjustment.

Prior art shows some adjunct uses of adhesive in garments, including brassieres, but does not show the restickable or repositionable variety in use with its particular advantages. In the prior art a backless, strapless bra with adhesive is taught were the adhesive is intended to stick the bra to the wearer's skin. The adhesive does not serve to adjust or connect a part or parts of the bra garment to itself as taught by the present invention. Additionally, it is taught in the prior art that an adhesive add-on may server to correct a rolling problem for larger women. The prior art does not teach, suggest, or make obvious the use a restickable or repositionable adhesive to adjust the bra for size, length, or angle for the wearer as taught by the present invention.

SUMMARY OF THE INVENTION

The very wide strap or garment style shoulder bra is designed to provide a range of improvements/benefits. The width at the point where it joins the full support bra is very wide to collect the weight to be supported more broadly and provide non-pivoting stability—i.e., the strap is unlikely to drop off the shoulder while wearing. The width at the strap apex provides a wider point of contact to distribute the weight without stress to this wider point of contact on the wearer's shoulder.

As the strap is wide and of an elastic material, it does not cut into the flesh and produce visible bra lines. In general, this structure produces a thorough bra support with a gentle, broad point width strap support. This brassiere may have any level support cup style of construction, such as a one-piece molded cup, or one shaped by detailed pattern tailoring, with or without additional underwire support.

The elastic knit, for example, but not restricted to, transparent mesh nylon, straps would be sewn, with or without a connecting neckline between the straps, directly to the uppermost edge of the cup area of the front. The straps then taper somewhat upwards, towards the apex point of the shoulder. The back ends of the straps embody the points of adjustable attachment. The horizontal side panel is prepared to receive the wide strap or garment style shoulder ends in order to create both a length and angle adjustable attachment by means of any one or any combination of the following.

The front side panels are composed of two elastic material layers forming the horizontal bands going from the sides of the cups around to the back of the brassiere. These two layers form a pocket open at the top and possibly at the bottom also of each horizontal band, left and right sides, in order to receive the wide strap or garment style shoulder ends. The pocket formed by the horizontal band layers is prepared to length and/or angle adjustably attach the strap ends by means of one or a combination of any of the following.

A row of low-profile male-female snaps, facing each other on the insides of the pocket, that will fasten through an open weave pattern in the ends of the wide strap or garment style shoulder. An arrangement of elastic or patched hook and loop tapes on the insides of the horizontal band pocket edges that will fasten through an open weave pattern in the ends of the wide strap or garment style shoulders. The two sides of the insides of the horizontal band pockets shall incorporate, facing each other, separate coatings of a restickable/repositionable permanent adhesive that will close upon the strap ends at the desired length and/or angle, one coating from each interior side, to secure the strap ends to the horizontal side to back bands.

This adhesive, formulated by anyone skilled in the art of adhesive formulation, would be washable as part of a washable garment; would adhere permanently to the garment after application, after drying/setting; the resulting permanent face would be restickable/repositionable in service to the adjustment, closure or connection of the garment in part or whole to serve the individual, and possibly changing, requirements of the garment wearer.

BRIEF DESCRIPTION OF THE DRAWINGS

The accompanying drawings, which are incorporated herein an form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
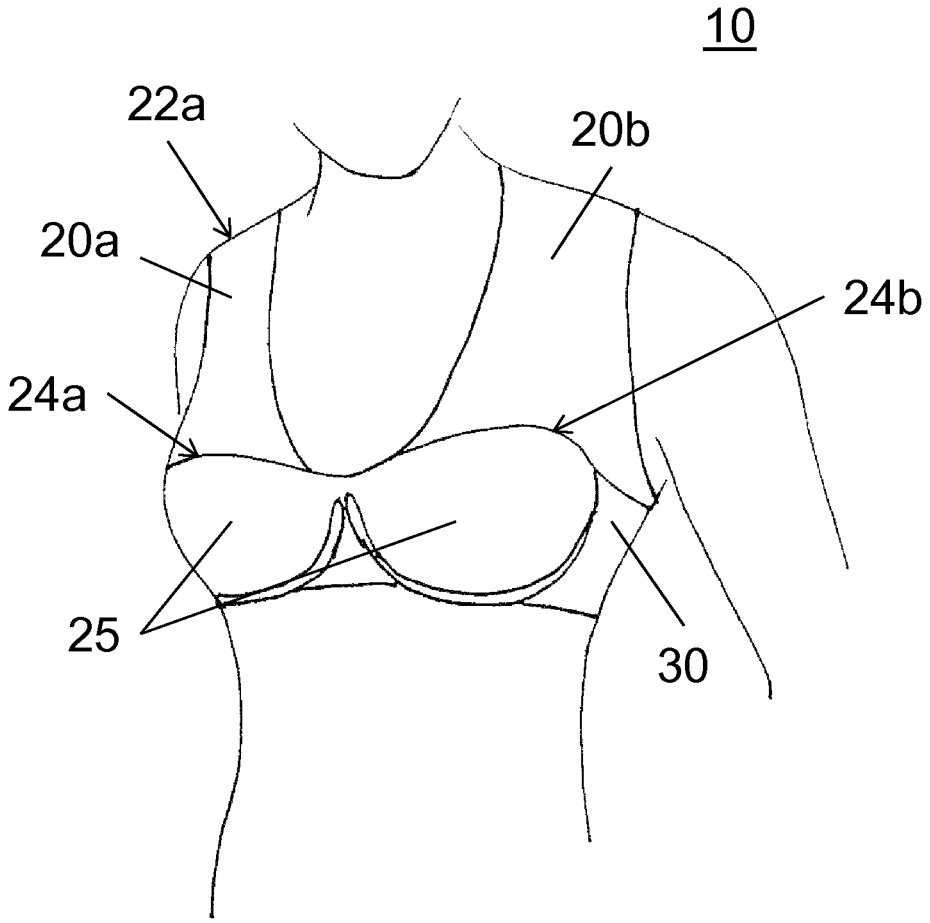
FIG. 1 is a front perspective view of an embodiment of the present invention illustrated on the body of a wearer.

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figures, it is possible to see the various major elements constituting the apparatus of the present invention.

Now referring to the Figures, the present invention is an upper body support undergarment, which is designed to provide comfortable and attractive upper body support. The upper body undergarment, designated as 10, 10*a* and 10*b* in the drawings, is particularly constructed to support gently, comfortably, but firmly.

Referring first to FIG. 1, the upper body undergarment 10 has two wide strap or garment style shoulders, 20*a* and 20*b*, connected to a full-support bra, 25 at front points 24*a* and 24*b*. The straps may be made from any suitable material, including but not limited to nylon sheer stretch mesh, nylon, polyester, acrylic, cotton, silk, SPANDEX, LYCRA SPANDEX, ELASTANE, or similar fabrics. The strap is widest at the points of attachment to the bra, 22*b*, in this case the front of the subject embodiment where it is stitched directly to the cups, 25, or made removable as per the description of the back ends of the straps. The straps then taper towards the apex of the shoulders, 22*a*, to fit the width of a wearer's shoulders.

The cups of the brassiere, 25, can be of any method or material generally employed in the art of support bra construction, including but not limited to, molded cups, tailored patterning cups, with or without padding or underwires or other techniques traditional or new to the art of bra making. The side panels of the brassiere, 30, connect from the outer sides of the cups around to the back of the wearer, and also serve as the means for connecting the wide strap or garment style shoulders.

Figure 2:
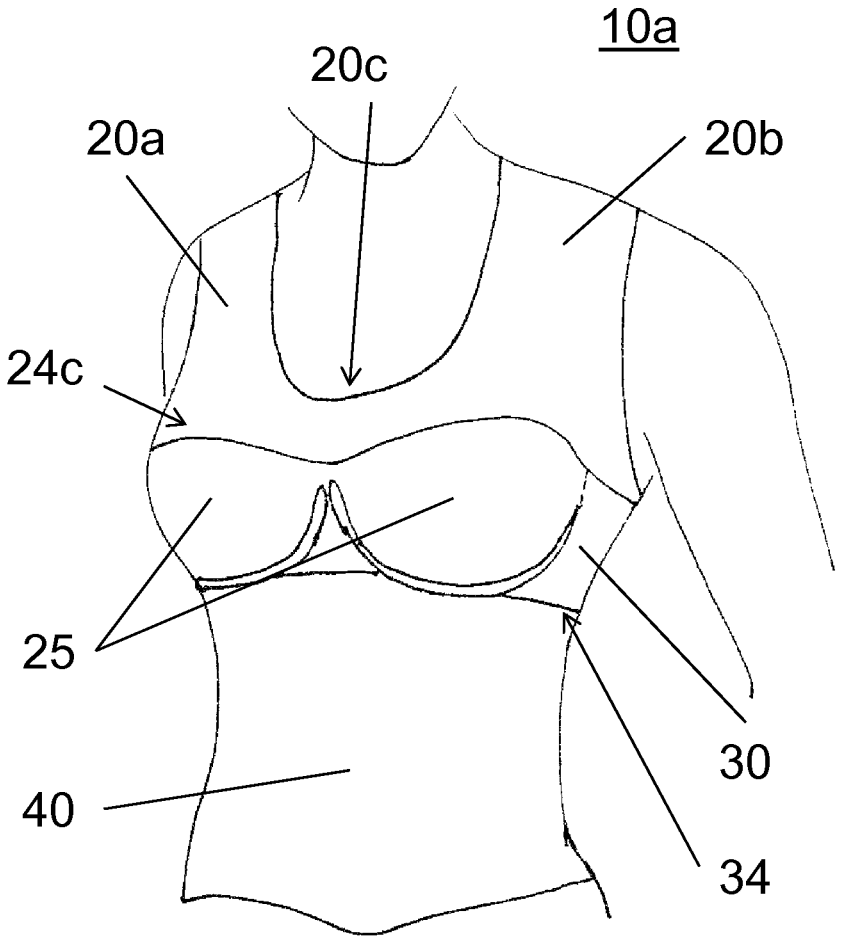
FIG. 2 is a front perspective view of an embodiment of the present invention illustrated on the body of a wearer.

FIG. 2 illustrates an embodiment of the invention which includes the two straps joined in the front to form a neckline, 20*c*, which may be of any neckline configuration, including but not limited to U-shape, V-shape, square, boatneck, sweetheart, etc., Joined to the brassiere along point 24*c*.

FIG. 2 also illustrates an embodiment that includes a permanent or detachable panel 40 covering the midriff below the bra, joined at point 34, in a length that may be designed to any practical length, with any desired hemline configuration, in this particular embodiment the hemline curves downwards towards the front center. This embodiment illustrates closing the invention around the wearer's body at the back, but may be closed elsewhere, including the front.

Figure 3:
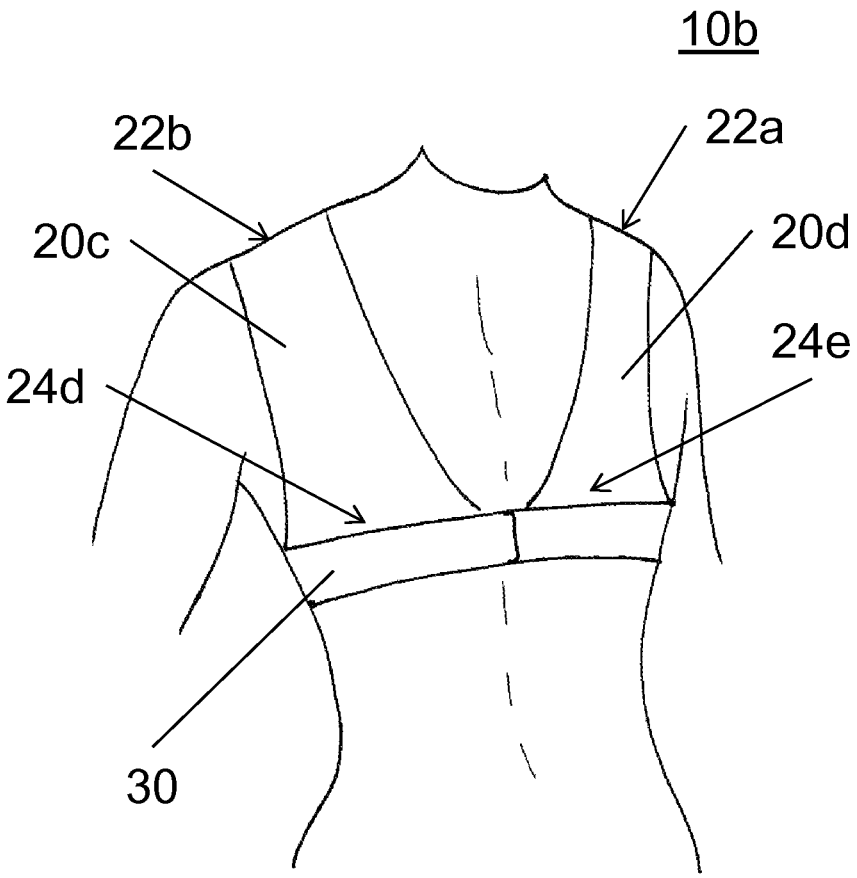
FIG. 3 is a rear perspective view of an embodiment of the present invention illustrated on the body of a wearer.

FIG. 3 illustrates embodiment 10*b* on the body of a wearer from the back, in this embodiment a back closure. It illustrates the tapering width from the apex of the shoulders, 22*a* and 22*b*, where it is a narrower width, to joining points 24*d* and 24*e*, where the width is wider to provide stability and gentle broad-point support. With respect to the width of the strap, the strap tapers from the cups 25 to the apex of the shoulders, 22*a* and 22*b* but the strap increases in width when going from the apex of the shoulders 22*a* and 22*b* to the cups 25 and horizontal side panel 30 so that the front strap ends that are attached along the tops of the cups 25 in front and the back strap ends stitched or attached to the horizontal side and back panel meet at a point under the arm.

Figure 4:
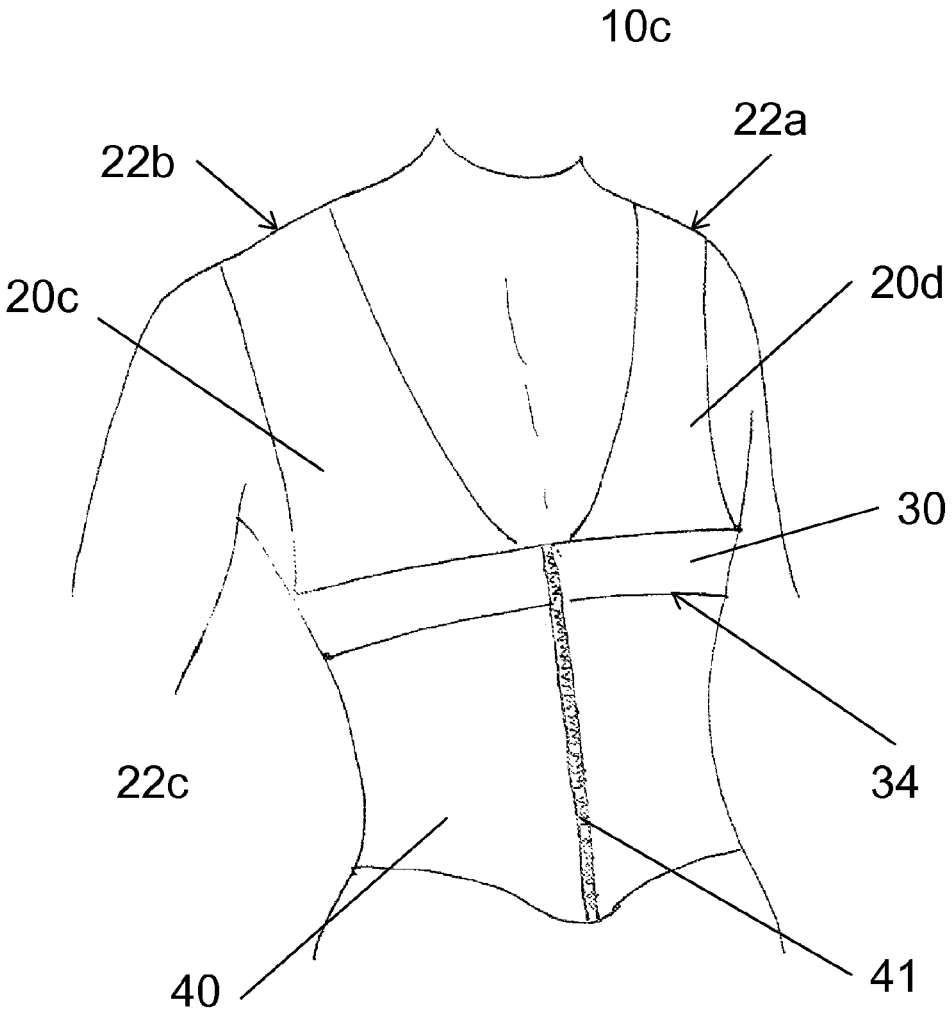
FIG. 4 is a rear perspective view of an embodiment of the present invention which includes a midriff covering panel.

FIG. 4 illustrates embodiment 10*c* on the body of a wearer from the back, with a midriff panel 40, here shown with a back zipper 41, but could function with a front closure, with alternate means such as clips, hooks, snaps, or other mechanical means traditional or new to the art of garment making. The long line/midriff version of the present invention also includes an embodiment without closure for a stretch or compression fit step-in or pull over style as further taught by FIG. 7.

Figure 5:
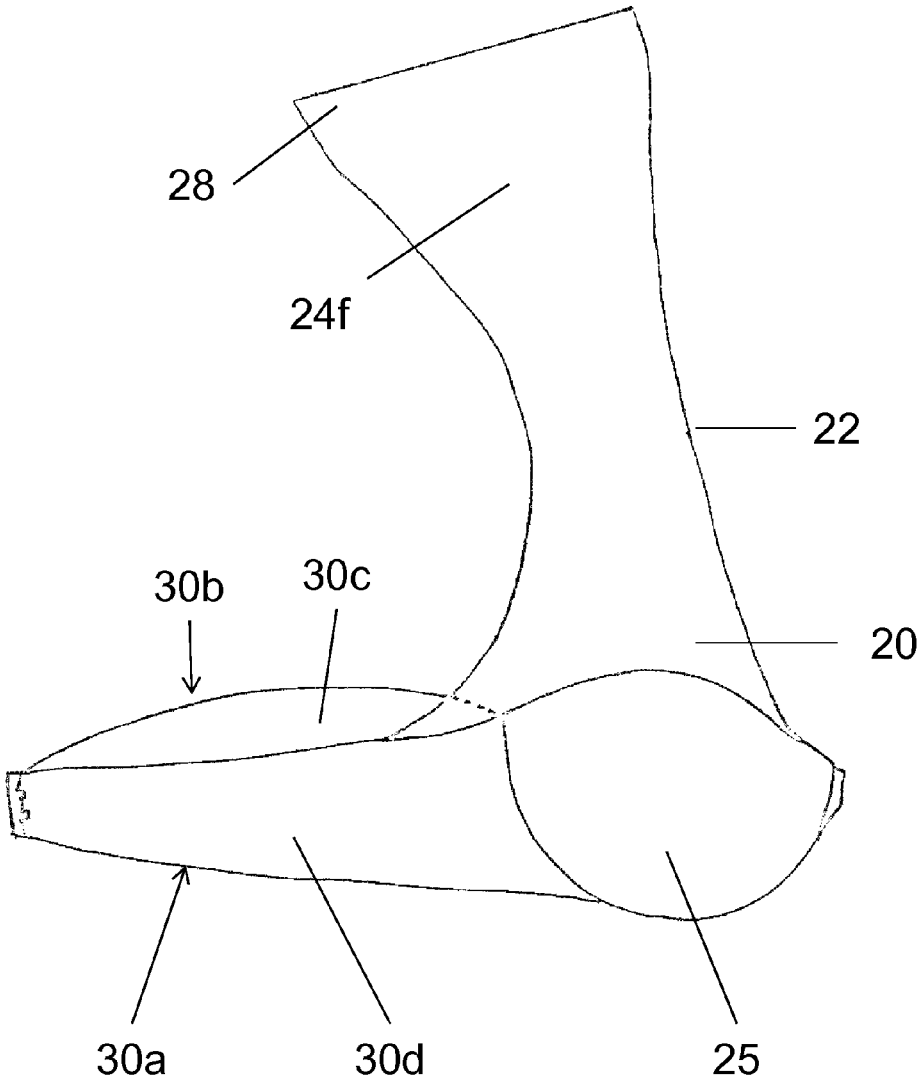
FIG. 5 illustrates the bra in its relaxed, unworn condition with the back end of the strap, extended unconnected to the horizontal side panel.

FIG. 5 illustrates the bra 10 in its relaxed, unworn condition with the back end of the strap, 20, extended unconnected to the horizontal side panel, 30. The horizontal side panels are of two layers of material, exterior to the body of a wearer 30*a*, and interior facing the body of a wearer 30*b*. In this manner the horizontal side panel may open to accept a method or methods to enclose the strap end 28. In a repositionable/restickable adhesive embodiment, the facing interiors of the two layers of material 30*a* and 30*b*, noted as 30*c* and 30*d*, forming the horizontal side panel, 30, would each be interiorly lined with a layer of the adhesive, formulated to be washable for a washable garment.

This repositionable/restickable adhesive lined interior would adhere to the bra strap end 28 on both sides of the strap end, creating a secure but repositionable connection. Once the strap was attached to the wearer's preferred fit, the strap would just be left securely in place between wearings, with the surfaces 30*c* and 30*d* closed upon the strap end 28, and laundered in the ordinary manner, leaving the glue surfaces unexposed to lint or direct abrasive action. This would serve to preserve the adhesive effectiveness of the adhesive over time.

This repositionable/restickable adhesive may or may not be reinforced by snaps, hooks, hook and loop tape or swatches, or other means to more firmly secure stress points. This repositionable/restickable adhesive may be part of the closure or connection of other garments beyond use in a brassiere, for example, in outerwear requiring closure, adjustment, or connection.

This repositionable/restickable adhesive applied in a thin layer, has the advantage of presenting a thin, smooth profile, and therefore less likely to show in relief through outerwear garments worn over an undergarment such as a bra.

Also in FIG. 5, 24*f* illustrates how the strap end might be positioned not only for length, but also for angle, here as would be angled to conform to a slight downward slope of a wearer's shoulder.

Figure 6:
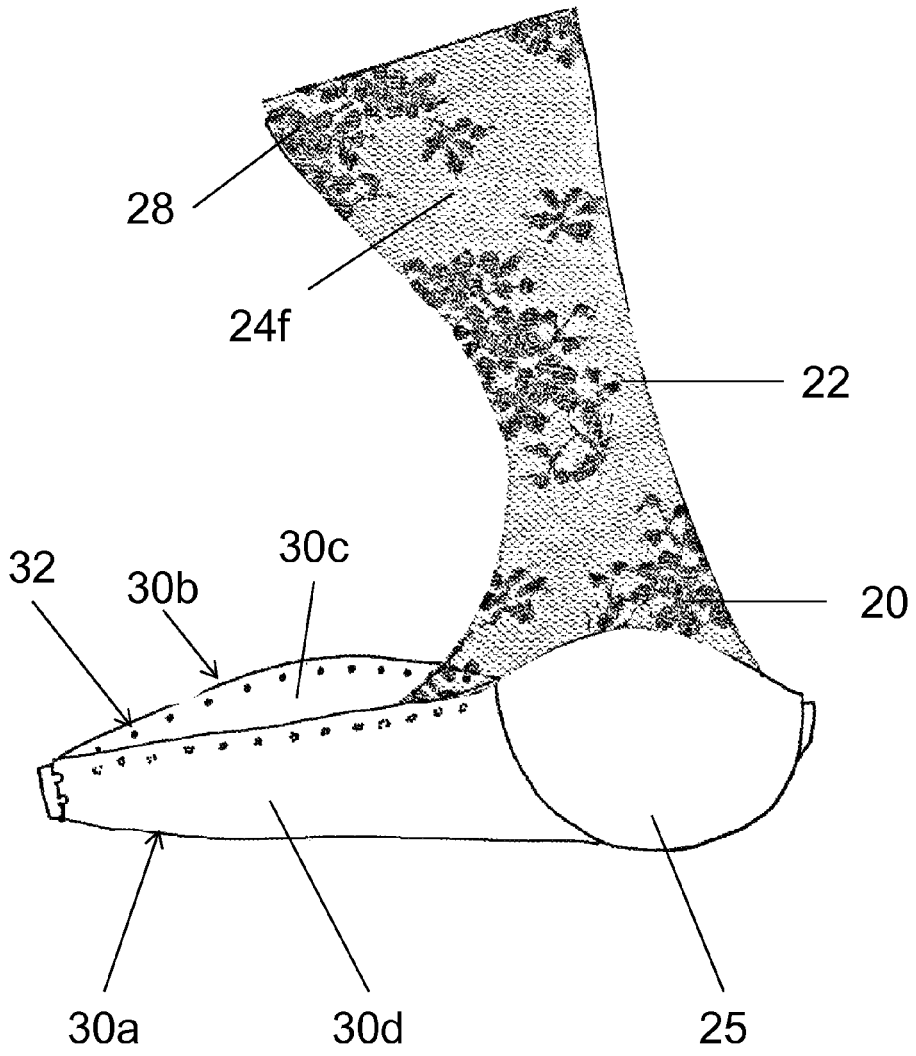
FIG. 6 illustrates how a strap made of lace or other open weave material could be fastened to horizontal side band.

FIG. 6 illustrates how a strap made of lace or other open weave material could be fastened to horizontal side band 30 by means of a row of snaps, hooks, or stretch hook and loop tape, or combination thereof, 32, which would fasten through the open weave of the material of the strap, 28. The back ends of the straps may be stitched directly to the horizontal side panel. Any of these methods or combination thereof could be employed to create completely removable straps and/or completely removable midriff panel 40 of FIGS. 2 and 4.

Figure 7:
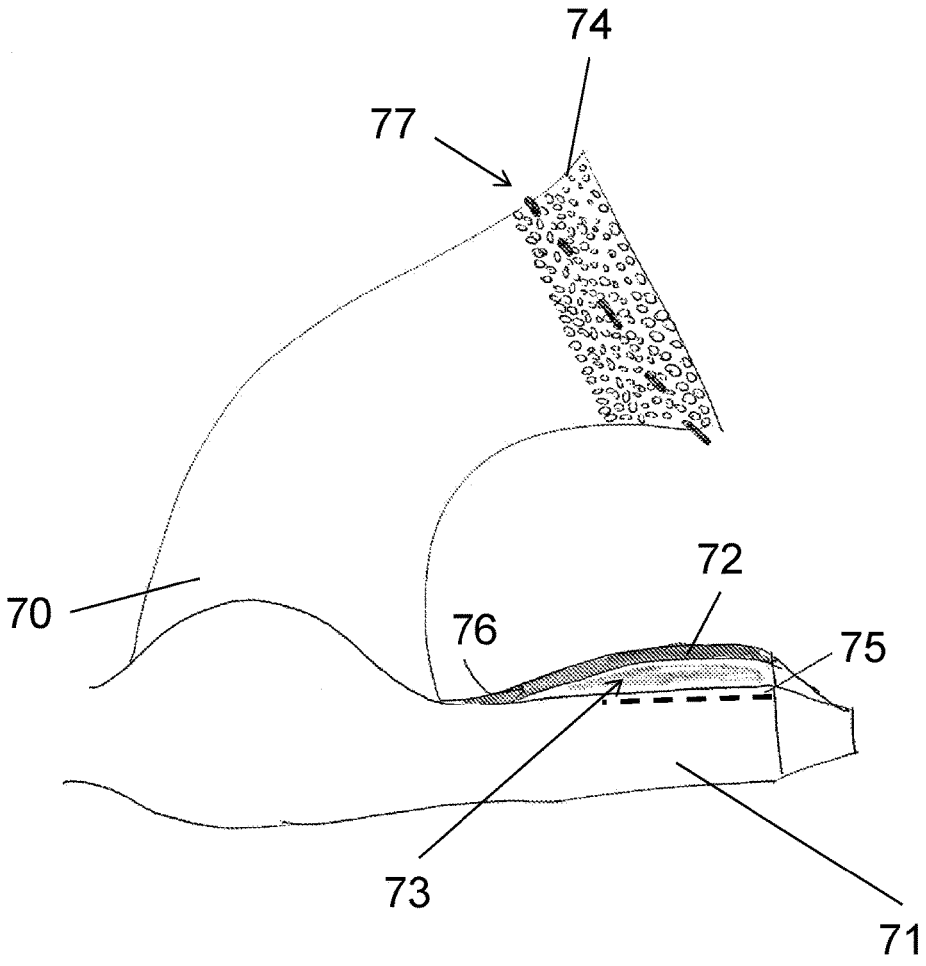
FIG. 7 is a diagram illustrating the flexible adjustment, strap, front cup, front side panel, stretch hook tape, back side panel, and the pocket formed by the front and back panels to accept the strap end between the hook and loop fasteners.

Now referring to FIG. 7, the strap 70 is wide and of an elastic material, it does not cut into the flesh and produce visible bra lines. In general, this structure produces a stable, secure bra support with a gentle, broad point width strap support. This brassiere may have any level support cup style of construction, such as a one-piece molded cup, or one shaped by detailed pattern tailoring, with or without additional underwire support.

Most wearers do not need any mechanical adjustment to the garment's shoulder-style straps, as the stretch of the mesh or other knit fabric will adjust naturally to the wearer firmly but gently providing a compression fit. The present invention is thereby novel and non-obvious over the prior art based on this difference, whereby wearer friendly simplicity of use/wearing and a reducing in manufacturing cost, time, and materials is found.

The elastic knit straps would be sewn, with or without a connecting neckline between the straps, directly to the uppermost edge of the cup area of the front. The straps then taper somewhat upwards, towards the apex point of the shoulder. The back ends of the straps embody the points of adjustable attachment. The horizontal side panel is prepared to receive the wide strap or garment style shoulder ends in order to create both a length and angle adjustable attachment by means of any one or any combination of the following as shown in FIG. 7.

Still referring to FIG. 7, the front side panels 71 are composed of two elastic material layers forming the horizontal bands 72 going from the sides of the cups 25 around to the back of the brassiere. These two layers form a pocket 73 open at the top and possibly at the bottom also of each horizontal band, left and right sides, in order to receive the wide strap or garment style shoulder ends. The pocket 73 formed by the horizontal band layers 72 is prepared to length and/or angle adjustably attach the strap ends by means of one or a combination of any of the following.

A row of low-profile male-female snaps, facing each other on the insides of the pocket, that will fasten through an open weave pattern in the ends of the wide strap or garment style shoulder. An arrangement of elastic or patched hook and loop tapes 76 on the insides of the horizontal band pocket edges 76 that will fasten through an open weave pattern in the ends of the wide strap or garment style shoulders 74. The two sides of the insides of the horizontal band pockets 73 shall incorporate, facing each other, separate coatings of a restickable/repositionable permanent adhesive that will close upon the strap ends at the desired length and/or angle, one coating from each interior side, to secure the strap ends to the horizontal side to back bands.

The flexible adjustment uses an open weave or eyelet pattern which allows stretch hooks on tape to reach through the strap and attach to loops on stretch tape. Plane 77, represented by the dashed/broken line, illustrates how the flexible adjustment might attach is the wearer had sloped shoulders.

This adhesive, formulated by anyone skilled in the art of adhesive formulation, would be washable as part of a washable garment; would adhere permanently to the garment after application, after drying/setting; the resulting permanent face would be restickable/repositionable in service to the adjustment, closure or connection of the garment in part or whole to serve the individual, and possibly changing, requirements of the garment wearer.

In another embodiment of the present invention, the shoulders would be knotted like hosiery Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. An upper torso undergarment for supporting the human female body comprising:

a first breast cup and a second breast cup;

a first connecting band and a second connecting band, each of which has a respective first end and a second end;

wherein the first end of the first connecting band is coupled to the first breast cup and the first end of the second connecting band is coupled to the second breast cup, and wherein the respective second ends of the first and second connecting bands are coupled to each other;

a first strap and a second strap, each of which has a first end and a second end, wherein the first end of the first strap is coupled to the first breast cup and the first end of the second strap is coupled to the second breast cup;

the first and second straps are shoulder straps or garment supporting straps;

wherein each of the first and second connecting bands comprises an outer layer and an inner layer;

wherein the second end of the first strap is adjustably secured between the outer layer and the inner layer of the first connecting band and the second end of the second strap is adjustably secured between the outer layer and the inner layer of the second connecting band; and the garment is for the function of supporting the breasts of the wearer when worn.

2. The upper body undergarment in claim 1, wherein the second end of the first strap is adjustably secured between the outer layer and the inner layer with adhesive.

3. The upper body undergarment in claim 2, wherein the adhesive is releasable and resealable.

4. The upper body undergarment in claim 1, wherein the second end of the first strap is releasably secured between the outer layer and the inner layer of the first connecting band.

5. The upper body undergarment in claim 4, wherein a group of hooks and snaps releasably secures the second end of the first strap between the outer layer and the inner layer of the first connecting band.

6. The upper body undergarment in claim 5, wherein the group of hooks and snaps releasably securing and positioning the straps are located on an inner surface of the respective inner and outer layer of the first connecting band.

7. The upper body undergarment in claim 1, wherein the first and second straps are connected proximate to the breast cups.

8. The upper body undergarment as claimed in claim 1, wherein the garment is a bra.

9. An upper body undergarment for supporting the human female body, the garment comprising;

a first breast cup and a second breast cup;

a connecting band having a first end and a second end, wherein the first end of the connecting band is coupled to the first breast cup and the second end of the connecting band is coupled to the second breast cup;

a first strap and a second strap, each of which has a first end and a second end, wherein the first end of the first strap is coupled to the first breast cup and the first end of the second strap is coupled to the second breast cup;

the first and second straps are shoulder straps or garment supporting straps;

wherein the connecting band comprises an outer layer and an inner layer;

wherein the second end of the first strap is adjustably secured between the outer layer and the inner layer of the connecting band and the second end of the second strap is adjustably secured between the outer layer and the inner layer of the connecting band;

a pocket formed by the straps and connecting band is able to be lengthened and be angularly and adjustably attached to the strap ends;

the first and second breast cups are releasably coupled to each other; and the garment is for the function of supporting the breasts of the wearer when worn.

10. A bra comprising:

a pair of breast cups;

a horizontal band comprised of two layers of material with mechanical snaps, hooks, or hook and loop tapes inside the two layers to attach a wide strap or garment style shoulder strap end and/or midriff panel on the bra;

a pair of front side panels composed of two elastic material layers forming the horizontal band going from the breast cups around to a back of the bra;

these two layers form a pocket open at a top and a bottom side of each horizontal band at left and right sides of each horizontal band, in order to receive a wide strap or garment strap style shoulder ends;

a pair of horizontal side panels are composed of two layers of material, an exterior configured to be exterior to the body of a wearer and an interior configured to be facing the body of a wearer;

a pocket formed by the horizontal band layers is prepared to lengthen and/or angularly adjustably attach the strap ends;

a row of low-profile male-female snaps, facing each other on inside surface of the pocket, fasten through an open weave pattern in the ends of the wide strap or garment strap; and two inner sides of the horizontal band pockets insides shall incorporate, facing each other, separate coatings of a restickable/repositionable permanent adhesive that will close upon the strap ends at the desired length and/or angle, one coating from each interior side, to secure the strap ends to the horizontal side to back bands.

11. The bra of claim 10, further comprising:

a strap running from the breast cup to the back horizontal band having a widest width at the apex configured for wear over a wearer's shoulder providing a wider point of contact to distribute weight without stress to this wider point of contact on the wearer's shoulder; and the strap is widest in the front and back to distribute support broadly over the wearer's shoulder.

12. The bra of claim 10, wherein the left and right straps are connected by a neckline into one piece.

13. The bra of claim 10, wherein the strap is composed of nylon sheer stretch mesh, nylon, polyester, acrylic, cotton, silk, spandex, or elastane.

14. The bra of claim 10, wherein the strap includes anyone of the following elements including an eyelet, an open weave pattern material, or an open knit pattern material at the strap along the strap edges, or in its entirety.

15. The bra of claim 14, wherein the two panels fasten hook and loop elastic tapes; and snaps and hooks which attach through the eyelet or open weave pattern strap material.

16. The bra of claim 15, wherein the pockets are lined with repositional adhesive formulated for washable garments; and the repositional adhesive is secured to the strap by any one of a stabilizing hook, a snap, or a hook and loop swatch.

17. The bra of claim 10, further comprising a removable or permanent long line abdominal smoothing panel, covering the stomach, sides, and back; and the removable or permanent long line abdominal smoothing panel attached to the horizontal strap and cups of the bra by any one of a zipper, a hook, a hook and loop fastener, or a restickable glue attachment and closure, or combination thereof.

* * * * *